United States Patent [19]

Yanai

[11] 3,986,487

[45] Oct. 19, 1976

[54] ROTARY TYPE FUEL INJECTION PUMP

[75] Inventor: Tokiyoshi Yanai, Yokosuka, Japan

[73] Assignee: Nissan Motor Co., Ltd., Yokohama, Japan

[22] Filed: Aug. 28, 1974

[21] Appl. No.: 501,470

[30] Foreign Application Priority Data

Aug. 29, 1973 Japan ..... 48-96171

[52] U.S. Cl. ..... 123/139 AE; 123/139 AL; 123/140 MC; 417/270; 417/294

[51] Int. Cl.[2] ..... F02M 39/00

[58] Field of Search ..... 123/139 AL, 139 AE, 123/139 AA, 140 MC, 140 MP; 417/294, 270

[56] References Cited

UNITED STATES PATENTS

| | | | |
|---|---|---|---|
| 1,222,148 | 4/1917 | Seymour | 123/140 R |
| 2,448,347 | 8/1948 | Beeh | 123/140 MP |
| 2,573,792 | 11/1951 | Jakobsen | 417/294 X |
| 2,619,080 | 11/1952 | Weber | 123/140 R |
| 3,319,568 | 5/1967 | Repko et al. | 123/140 R X |
| 3,375,811 | 4/1968 | Morris | 417/294 X |
| 3,454,283 | 7/1969 | Benjamin et al. | 64/31 X |
| 3,789,627 | 2/1974 | Smith | 64/31 |
| 3,856,438 | 12/1974 | Simko | 417/270 |

*Primary Examiner*—Charles J. Myhre
*Assistant Examiner*—Tony M. Argenbright

[57] ABSTRACT

A fuel injection pump of rotary type for use in an internal combustion engine, which incorporates a fuel injection control mechanism comprising a mechanical governor arrangement through a mechanical coupling of self-centering and vibration absorbing character in the driving train of such rotary components as a face cam shaft for driving a plurality of plunger pumps disposed radially and a control shaft for axially shifting a metering sleeve. The metering sleeve is specifically designed for adjusting the opening areas of a plurality of metering orifices defined radially in the inner circumferential surface of a barrel of the fuel injection pump for communication with the radially disposed plunger pumps. The governor is designed for adjusting axially the location of the metering sleeve relative to the metering orifices so as to change the opening areas of such metering orifices in response to the changes of the rotating number of the driving train, and also designed for compensating the basic operating position of the governor in relation to the operating status of a booster adapted to respond to the changes of air intake pressure of the engine, so that proper fuel injection may be attained with a constant delivery of the plunger element thereof in the range of small flow rate of the fuel.

1 Claim, 10 Drawing Figures

FIG. 2
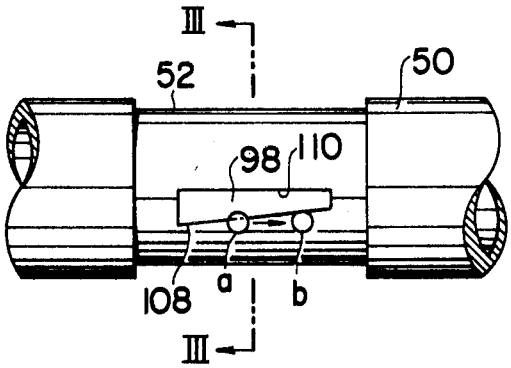
FIG. 3
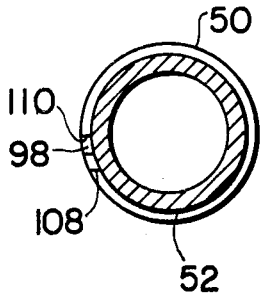
FIG. 4
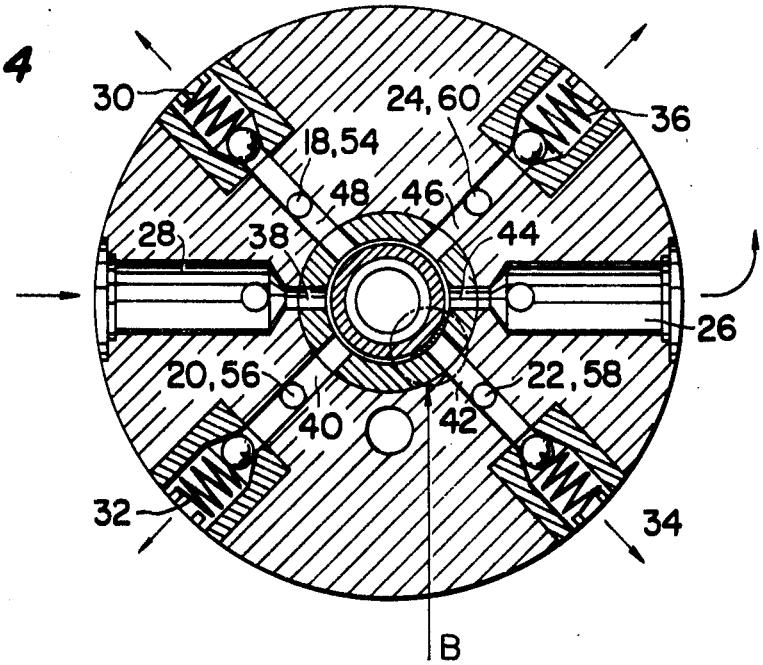
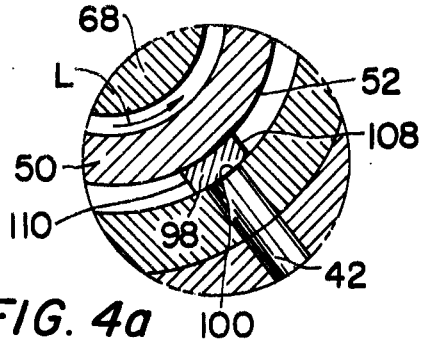
FIG. 4a

ROTARY TYPE FUEL INJECTION PUMP

The present invention relates in general to a fuel supply system, and particularly to a fuel injection pump in use for a fuel system for an internal combustion engine. More specifically, this invention is concerned with the improvement in or relating to a rotary type fuel injection pump of a small flow rate, which particularly features its control mechanisms incorporated for fuel injection operation, and in which there are arranged a plurality of equally spaced and radially disposed plunger pumps, of the number corresponding to that of engine cylinders, as well as a plurality of fuel passageways communicating distributor valves with the central bore of a barrel through the above mentioned plunger pumps, and there is provided fuel supply of desired quantity and timing corresponding to an air intake pressure or negative pressure of the engine by the reciprocating motion of each plunger created by the rotating motion of a face cam, and by the rotating and reciprocating motions of a metering sleeve within the central bore of the barrel of the pump.

The basic arrangement of such type rotary fuel injection pumps has heretofore been well known, and there have been proposed many design variations of such type pump till today. However, with respect to a plunger pump and a fuel injection pump of small flow rate, such as in the order of 10 $mm^3$ or less of delivery per stroke of a plunger thereof, there have been realized as yet none of satisfactory control mechanisms therefor, wherein the operational relationship of the metering cam of a metering sleeve and the metering port of a barrel, which is of a most importance in such design, may be varied in accordance with the state of a suction or air intake (negative) pressure of the engine cylinders, and further, compensated in accordance with the engine revolution as well. In addition, as controls have been increasingly intensified against the environmental pollutions by automotive engines, etc. and the regulations for such controls have become steadily severer, it is further essential for the manufacturers of such automotive engines to impose the betterment or quality and/or performance standards thereof. Under such circumstances, the improvement of a fuel injection pump in use for such automotive engines has likewise been required strongly for a precisely controlled fuel injection operation which was liable to be influenced by the engine or pump revolution in the range of small flow rate with the conventional arrangement.

In general, if a fuel injection pump is directly driven by the driving train of the pump, it is natural that if a certain fuel injection volume of a pump is predetermined at a certain rotational number thereof at an air intake pressure point of the engine, the fuel injection volume per stroke of each plunger increases as the revolution thereof increases. Particularly, in the case of a small capacity fuel injection pump of the conventional arrangement, having such a flow rate range of 10 $mm^3$/st or less, it is observed that since the fuel injection pump is likely to begin fuel injection operation as its revolution speed increases, even when the metering cam does not close completely the metering orifice of the pump, there occurs consequently an increase of fuel injection volume per stroke of each plunger in the fuel pump. That is to say, the fuel injection volume is entirely under the influence of the rotational number of a fuel injection pump. In this consideration, for precisely controlling the pump delivery in response to air intake pressure of the engine within the abovementioned range of small flow rate of the pump, such a mechanism is essentially required which is adaptable to compensate the fuel injection volume per stroke of each plunger at a predetermined constant point irrespective of any pump revolution. This invention is essentially directed to meet such requirements for an improved rotary type fuel injection pump which is specifically designed with an entirely new control mechanism as referred to above.

It is therefore a primary object of this invention to provide an improved rotary type fuel injection pump, whereby a precisely controlled fuel injection operation is attained by using a control mechanism incorporating a mechanical governor therein which is responsive to the engine or pump revolution speed.

It is another object of this invention to provide an improved rotary type fuel injection pump incorporating a control mechanism wherein the metering sleeve of the fuel pump is forcibly moved under the biasing force of a mechanical governor so as to vary the position where the metering orifice thereof passes through the metering cam surface and eventually maintain the fuel injection quantity of the pump per stroke of each plunger at a predetermined point.

It is still another object of this invention to provide an improved rotary type fuel injection pump incorporating a mechanical governor wherein the governor is supported through suitable coupling means so as to effectively cut the transmission of mechanical vibrations to the metering sleeve of the pump which are inherent to such governor design.

It is a further object of this invention to provide an improved rotary type fuel injection pump wherein there is provided lubrication between the metering sleeve and the barrel of the fuel pump so as to effectively prevent a heat seizure or burning therebetween.

According to this invention, briefly summarized by way of a preferred embodiment thereof, there is provided an improved rotary fuel injection pump which comprises barrel means defining a central bore and first passageways communicating the central bore; barrel or housing means formed separately with the barrel means, including a plurality of plunger pumps disposed in generally radial relationship with respect to the central bore of the barrel, and defining second passageways therewithin communicating with the first passageways through the plurality of plunger pumps; face cam means adapted to cause the plunger elements of the plurality of plunger pumps to be moved in reciprocating motion by the rotating motion of the face cam means, metering sleeve means disposed centrally in the central bore of the barrel; control shaft means extending centrally through the metering sleeve, one end of the shaft means engaging with the face cam shaft means and the other end thereof engaging with a booster, respectively; the booster being arranged to respond to the changes of air intake pressure of the engine, the control shaft means being adapted to receive rotating motion from the face cam shaft means while receiving axial sliding motion from the booster; governor means disposed on the control shaft means and adapted to supply the metering sleeve with urging force according to the rotating number of the control shaft means; resilient means disposed between a retainer on the control shaft means and the metering sleeve and adapted to urge the metering sleeve; and resilient means disposed between a large diametral portion for supporting the resilient means thereby projecting from the control shaft surface and the face cam shaft means, and adapted to urge the control shaft means; the metering sleeve means being arranged to be slidable axially so as to change the relative position of a metering cam surface thereof with respect to metering orifice means provided on the inner circumferential surface of the barrel means in general proportion to the rotating number of the face cam shaft means under the dynamic balance between the biasing force of the resilient means and the urging force rendered by the governor means, the control shaft means adapted to shift the basic operating position of the governor means by function of the balance between the urging force of the resilient means and the biasing force from the booster.

The nature, principle, and details of the present invention, as well as further objects and advantages thereof, will become more apparent from the following detailed description with respect to a preferred embodiment of the invention when read in conjunction with the accompanying drawings, in which like parts are designated with like reference numerals.

In the drawings:

FIG. 2 is a fragmentary enlarged view of the part A shown in FIG. 1;

FIG. 3 is a longitudinal cross sectional view taken along the plane designated by line III—III of FIG. 2;

FIG. 4 is a longitudinal cross sectional view taken along the plane designated by line IV—IV of FIG. 1;

FIG. 4*a* is an enlarged view of the area B shown in FIG. 4

Figure 5:
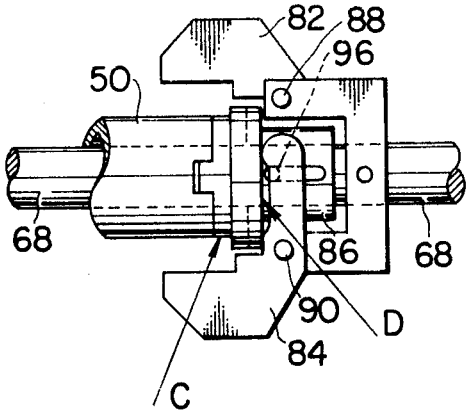
Figure 5B:
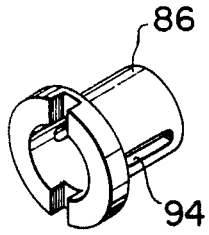
Figure 5A:
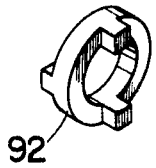
Figure 6:
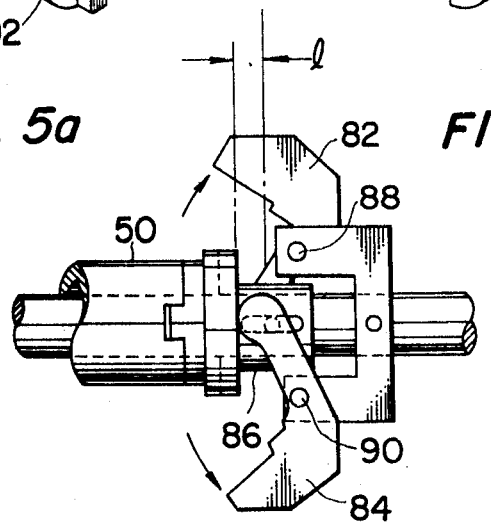

FIGS. 5 and 6 are enlarged views of a governor arrangement of this invention, by way of a first embodiment thereof;

FIG. 5*a* is a perspective view of part C as shown in FIG. 5;

FIG. 5*b* is a perspective view of part D as shown in FIG. 5; and

Figure 7:
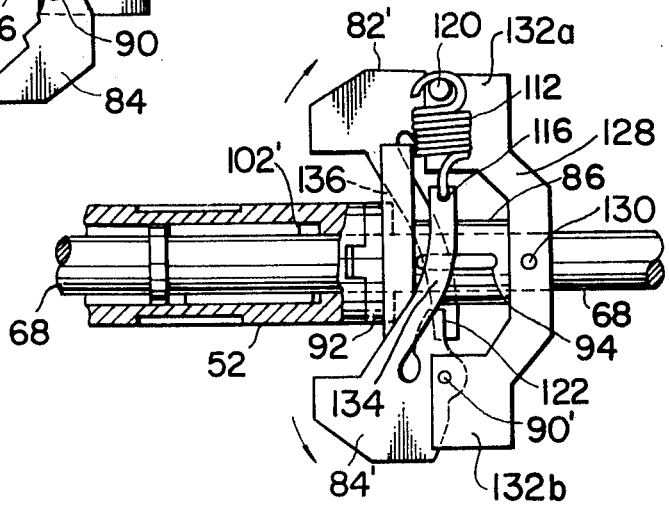

FIG. 7 is an enlarged view of a governor arrangement of this invention, by way of a second embodiment thereof.

In the accompanying drawings, there are shown, for illustrative purpose only but not in any way for limitations of, the preferred embodiment of an improved rotary type fuel injection pump according to this invention.

Figure 1:
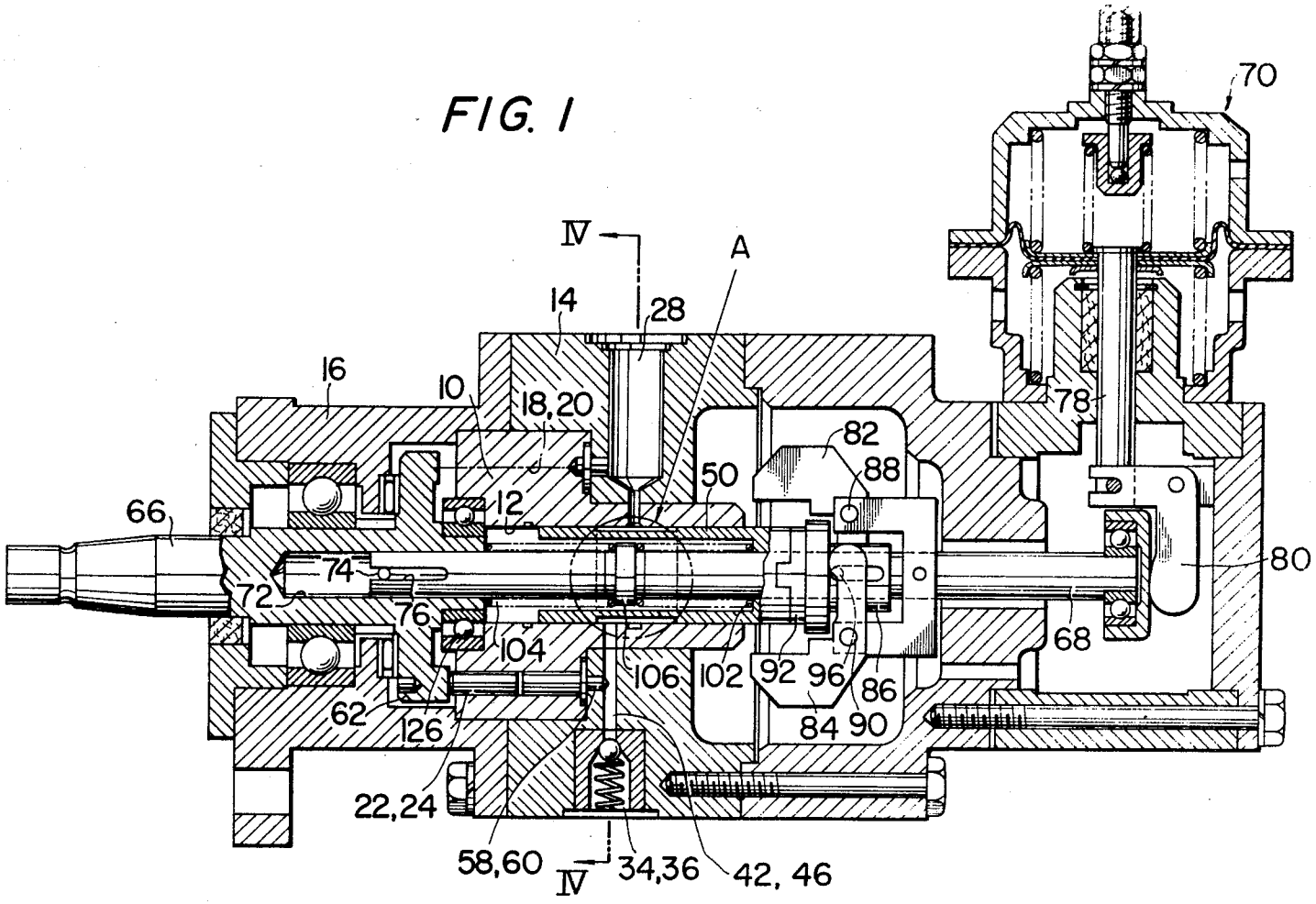
FIG. 1 is a longitudinal cross sectional view showing a rotary type fuel injection pump according to this invention by way of a preferred embodiment thereof.

Referring now to the accompanying drawings and particularly to FIG. 1, there are shown a barrel 10 having a central bore 12, and housings 14 and 16 including the barrel 10 in the central position thereof. The barrel 10 is rigidly incorporated in a central position of the housings 14 and 16, as shown in FIG. 1. And as shown in FIG. 4, there are provided a plurality of plunger pumps, of the number corresponding to that of engine cylinders (in this embodiment, four plungers are provided) 18, 20, 22, and 24 in equally spaced and radial relationship with respect to the central bore 12 of the barrel 10, and further, in the housing 14 there are provided a fuel outlet 26, a fuel inlet 28, and four delivery valves 30, 32, 34, and 36 corresponding to the number of the engine cylinders, respectively. Also, there are provided fuel passageways 38, 40, 42, 44, and 48 communicating the abovementioned fuel inlet and outlet and distribution valves with the central bore 12 within and across the barrel 10 and the housing 14. Consequently, the fuel is supplied under an appropriate pressure from the inlet 28 through the passageway 38 to a depression 52 of a metering sleeve 50, which will be described in details hereinafter, and after filling up this depression, the fuel is further directed through the passageways 40, 42, 44, 46 and 48, and the outlets 54, 56, 58, and 60 of the plunger pumps, back to a fuel tank, which is not shown, from the outlet 26.

On the other hand, in the housing 16 there is provided a face cam 62 adjacent the barrel 10, the cam surface thereof constantly abutting the ends of the plungers 18, 20, 22, and 24, and when the face cam 62 is driven in rotation, such plungers 18, 20, 22, and 24 being caused to move in reciprocation with the barrel 10 in the direction to and from right and left as viewed in FIG. 1. The reference numeral 66 designates a face cam shaft which is driven in rotation by a cam shaft of a craft shaft of the engine, not shown.

The numeral 68 designates a control shaft which is provided extending through the central bore 12 of the barrel, one end of which engages with the face cam shaft 66 while the other end thhereof engaging with a booster 70. For more details, one end of the control shaft 68 is, as shown in FIG. 1, inserted into an elongated central hole 72 of the face cam shaft 66 in such a manner that the slits provided at the leading end of the control shaft engage slidably with pin 74 provided transversally within the above mentioned elongated hole so that the control shaft may coaxially rotate with the face cam shaft but may move axially in slide motion with respect thereto, while the other end of the control shaft 68 may abut a lever 80 which is provided cooperatively with an air intake control mechanism shaft 78 of a booster assembly 70 through a bearing interposed therebetween. There is provided a mechanical governor assembly having a pair of mechanical governor weights 82 and 84 of pendulum type, which is rigidly located on the control shaft 68 by means of a set pin 84 which is for setting the governor assembly in position on the control shaft, and a retainer 86 is centrally disposed in the governor assembly on which the cam portions of the governor assembly rest in contact. As best seen in FIG. 5, the governor weights 82 and 84 are positioned swingably about fulcrum 88 and 90, so that they can swing open radially outwardly by function of centrifugal force rendered thereon during the rotating motion of the governor assembly as shown in FIG. 6, thus causing the retainer 86 to be pushed in the left direction as viewed in FIG. 6. The leading end of the extension of the retainer 86 is formed with a pair of projections of rectangular shape so as to slidably engage with the mating end of an Oldham's coupling element 92, which in turn with the mating end of a metering sleeve 50 in the same slidable connection as fully shown in FIG. 5. There is defined an elongated slot 94 in the retainer 86 which slot is designed for slidable engagement with a guide pin 96 studded on the control shaft so that the rotating motion of the control shaft may be straightly transmitted to the metering sleeve 50, thus being rotated in the central position of the stationary barrel 10.

The metering sleeve 50 is installed onto the control shaft 68 in such a manner that it may slide axially within the central bore 12 of the barrel. As shown in FIGS. 2 and 3, since there is provided an annular or circumferential depression 52 on the metering sleeve 50 and this depression 52 is provided with a cam shaped valve portion 98 having the same radius as that of the larger diametral sides of the sleeve 50, the metering orifices located at the ends of such fuel passageways 38, 40, 42, 44, 46 and 48, i.e., the openings of such passageways communicating with the central bore 12 of the barrel are adapted to be closed or opened by the cam 98 in succession as the metering sleeve 50 is rotated. In the operating position illustrated in FIG. 4, the metering cam 98 is in a position to close the metering port 100 of the passageway 42.

There are installed two coil springs 102 and 104 on the opposed sides of a spring retainer 106 of annular shape defined on the control shaft 68, both springs extending axially along the control shaft in such fashion that the former spring 102 is adapted to resiliently urge the metering sleeve 50 and the latter spring 104 is for urging the control shaft 68, thus compensating the axial movements of the sleeve 50 and the shaft 68 under the biasing force rendered by the governor and the urging force by the booster, rspectively.

With respect to the operation of the rotary type fuel injection pump of the conventional construction, i.e., without any special governor arrangement therein, the barrel 10, the face cam 62, the control shaft 68, the booster 70, the governor, the metering sleeve 50, and the springs 102 and 104, description will now be given in details hereinafter.

Firstly, the route of transmitting the driving power or the revolution in the rotary type fuel injection pump is such that the rotating motion of the face cam shaft 66 causes the control shaft 68 to be rotated through the pin 74 of the pin-and-slot coupling described hereinbefore, and the control shaft 68 in turn transmits the rotating motion thus obtained through the guide pin 96 to the retainer 86, the coupling 92, and subsequently the metering sleeve 50. Thus, the transmission of rotating motion is attained. Now, with respect to the fuel injection operation and the metering function of the fuel injection quantity, when there occurs the rotating motion in the movable components of the fuel pump, the fuel is admitted from the inlet 28 and fills up the depression 52 of the metering sleeve, the passageways 38, 40, 42, 44, 46 and 48, and the outlets 54, 56, 58, and 60 of the plunger pumps, thereafter returns to the fuel tank through the outlet 26.

As the plunger pumps in this embodiment are disposed in an equally spaced and radial relationship as described hereinbefore, description may be assumed on the operating position of any one of the plunger pumps 18, 20, 22 and 24, for the purpose of simplicity and clarity in the description. Now, the plunger pump 22 is taken for example for description. In the case that the plunger pump 22 is in such a position that it is pushed to the top dead center position thereof by the face cam 62, as the metering sleeve 50 rotates in the direction L shown in FIG. 4*a* within the central bore 12 of the barrel 10, there is such cooperative relationship that the leading edge 108 of the cam 98 disposed on the sleeve in the depression part thereof passes across the metering orifice corresponding to the plunger 18. When the motion velocity of the plunger increases due to a large rotating number of the face shaft 66, there could exist such a position that the quantity of fuel to be pushed out by the plunger 18 and the quantity of fuel to be discharged out of the above mentioned metering orifice reach an equilibrium with the metering orifice left unclosed completely. Subsequently, there follows a position that as the plunger 18 and the metering sleeve 50 continue their rotation further, the fuel pressure within the passageway 48 rises up, and when the extent of such accumulated pressure therewithin becomes higher than the maximum closing pressure rendered by the delivery valve 30, there begins fuel discharge from this delivery valve.

When the metering sleeve 50 continues its rotating motion further so that the metering orifice begins to open as the tail edge 110 of the cam 98 passes therethrough, the fuel pressure within the passageway thus drops, and consequently, the fuel injection from the delivery valve 30 is caused to cease at such point that the fuel pressure therewithin becomes lower than the valve closing pressure.

The above description was specifically made on the operating position of a given plunger 22, and such description is exactly true with the case of the other plunger 18, 20 and 24, thus the fuel being delivered out of the delivery valves 30, 32, and 36 in succession as the pump continues its rotation. As referred to hereinbefore, such a phenomenon to give rise to fuel injection while the metering orifice is not completely closed by the cam surface 96 of the metering sleeve 50 is liable to occur as the rotational number of the face cam shaft 66 increases. Further, in the case of a fuel injection pump of a small flow rate, the ratio of fuel injection operated while the metering orifice is not completely closed by the cam surface with respect to the total quantity of fuel injection by the pump trends to increase due to a small circumferential width of the cam surface, and consequently, the fuel injection volume per stroke of each plunger becomes liable to be influenced by the pump revolution speed.

On the other hand, after the above described operation, each of the plungers 18, 20, 22 and 24 is caused to come down to the original place of reciprocating motion thereof by function of a certain pressure applied on the fuel to be supplied from the tank so as to abut the lower surface 64 of the face cam 62, thus performing further cyclically reciprocating motion of the plungers in sequence given by the rotation of the face cam shaft 66. In this manner, if it is arranged that the uprising stroke of each plunger and the timing of closing the metering orifice by the metering cam are associated with each other, there occurs likewise such fuel injection in each of the engine cylinders in a desired sequence in accordance with the rotation of the face cam shaft, thus resulting in a proper fuel injection operation so desired.

With respect to the operation and effects performed by the rotary type fuel injection pump according to this invention, description will now be given on a fuel injection control mechanism including a specific governor arrangement therein of this invention. In this arrangement, as described briefly hereinbefore, there is arranged a booster 70 at the left end of the control shaft 68 in cooperation with rod and lever connection therebetween. When the booster 70 is applied with an air intake pressure or negative pressure from the suction tube of the engine, a suction pressure control shaft 78 is caused to lift upwardly as viewed in FIG. 1, thus a lever or bell crank 80 rotates or swings about a pivot thereof to a certain angle so that the control shaft 68 is caused to be pushed toward the left as viewed in FIG. 1. Along with such axial movement of the control shaft, thus resulting in axial travel of the retainer 86 fixed on the control shaft and the metering sleeve 50 through the Oldham's coupling 92 to the left following the control shaft movement.

As described hereinbefore, there is provided a cam 98 of a shape as shown in FIG. 2 in the circumferential depression 52 of the metering sleeve 50, as the metering sleeve 50 travels axially to the left as viewed in FIG. 2 together with the control shaft 68, there occurs a relative travel of the cam edge 108 with respect to the metering orifice opened to the central bore 12 of the barrel 10 from a position "a" to position "b". The cam has a trapezoidal shape in transversal section with gradually tapered or inclined edge 108 with respect to the edge 108 as best seen in FIG. 2. In this respect, as the metering sleeve 50 axially travels, the opening of the metering orifice which comes to cooperate with the cam 98 varies as schematically shown by the symbols a, b, thus obtaining variations in the controls of fuel injection volume. This is a first effect and function of the control mechanism incorporated in the fuel injection pump according to this invention.

In general, however, in such a metering mechanism as described above, if there increases the velocity of such transversal movement of the cam across the metering orifice, there exists such a specific trend to increase the fuel injection volume per stroke of each plunger, therefore it is now necessary to control in a secondary manner such increase in the fuel injection volume. According to this invention, such problem is met with the use of a mechanical governor arrangement adapted to provide such controls in response to the above mentioned fluctuations of air intake or negative pressure rendered upon the booster of the pump by the engine. Thus obtained is a second effect and function of the control mechanism according to this invention.

In operation, when the governor weights 82 and 84 are caused to lift open radially outwardly due to the rotating motion of the governor assembly, as best seen in FIGS. 5 and 6, the governor weights cause the retainer 86 to be biased axially a distance of which is generally proportional to the extent of change in the rotational number of the governor, thus causing the metering sleeve 50 to travel to the left as viewed in FIG. 6, which travel may cause the fuel injection volume to be decreased in predetermined proportion, thus realizing an effect to compensate the fuel injection volume which is liable to increase due to the arrangement for fuel injection controls by the cooperative motion of the cam and metering orifices.

When the rotating motions of the control shaft 68 and the metering sleeve 50 come to decrease, thus there occurs a necessity to control the fuel injection in a reverse direction. In such a case, the control shaft 68 in the mentioned travelled position as hereinbefore is now caused to be biased in a reverse direction by the urging force of the coil spring 104, or in the right as viewed in FIG. 1, and so caused in the metering sleeve 50 by function of the coil spring 102. For assuring such performance of reverse axial movement of the shaft and sleeve, there are provided such two springs separately on the opposite sides of the control shaft 68 through the larger diametral portion or spring retainer 106. This is one of the advantageous design features attained by this invention. As described hereinbefore, prior to use, each of the springs 102 and 104 is selected with its own urging force in connection with the biasing forces rendered by the governor and the booster, respectively. In this connection, the coil spring 102 shown in FIG. 1 is designed with a non-linear characteristic in an attempt that the displacement of the metering sleeve is generally in proportion to the variation of the governor revolution.

In FIG. 7, there is shown a second embodiment of a governor assembly according to this invention, wherein such a design concept is applied that a spring of non-linear characteristic described above is not used, and by function of a plurality of springs the displacement of the metering sleeve is made generally proportional to the variation of the governor revolution.

Referring to this Figure, the second embodiment of the governor is shown, which comprises a generally U-shaped armature member 128 securely connected at the central portion 130 to the control shaft 68 in such a manner that the leg portions 132*a* are symmetric to each other with respect to the control shaft 68, Each of the leg portions is provided with a pin 90' at the portion thereof as shown in the drawing. Pivotally connected to the pin 90' is a governor weight 84 which comprises a weight portion and a lever portion 134 extending from the weight portion toward the leg portion 132*a*, and a cam surface portion 122 abutting against a flange portion 136 of the retainer 86. A tension spring 112 is connected at one end thereof to the top end portion of the lever 134 and at the other end thereof to a pin 120 secured on the leg portion 132*a*. In operation, when the control shaft 68 is driven in rotation, the governor weights 82' and 84' are likely to swing open radially outwardly about the fulcrums thereof due to a centrifugal force created during the rotating motion thereof. For the purpose of simplicity and clarity, description on the operation of such governor weights is limited to one of them, for instance 84'. During rotation, a quadratic moment to the governor revolution is now produced at the fulcrum 90' of the governor weight 84' due to the centrifugal force induced thereby. As the governor weight 84' is pivotably held at a pin or fulcrum 90' on the armature 128 of the governor assembly, the extension part or the lever portion 134 of the governor weight being connected to one end of the tension spring 112 while the other end of the spring being connected to another governor weight, the governor weights may swingably open radially outwardly against the biasing force of the springs by function of centrifugal forces created thereon during rotating motion thereof. Consequently, the spring 112 may resiliently elongate in a non-linear manner, thus effecting a non-linear moment about the fulcrum 90' of the governor weight of the opposite direction to that of the moment produced by the centrifugal forces rendered on the governor weights. According to the differences between such moments, there occurs a differential force which effects a push the retainer 86 of the governor assembly through a cam surface 122 of the governor weight 84'. In this respect, it is now feasible to select such design factors as spring constant, spring span, etc., thereby to find a suitable spring having theoretically non-linear character in actual use.

Description will now be given on the operation of an Oldham's coupling 92 incorporated in the governor assembly of this invention in connection with the above mentioned effect and function of the control mechanism. As fully described hereinbefore, the application of the governor are found quite effective, and thus indispensable in connection with the fuel injection control operation, however, it is inevitable that there exists uneven static mass distribution or deviation in the construction of the governor weights 82 and 84 due to lack of precision, etc., in the machining process thereof, which static mass deviation would bring dynamic unbalance, thus producing undesirable mechanical vibrations. Such mechanical vibrations are liable to be immediately transmitted to the metering sleeve unless any cushioning member is provided therebetween, which vibrations would cause directly or indirectly heat seizure or burning between the metering sleeve and the barrel of the fuel injection pump of the conventional construction. In this consideration, according to this invention, there is provided an Oldham's coupling element 92 which is designed to cooperatively mate in a known manner between the leading ends of the retainer 86 and the opposed end of the metering sleeve 50 so as to cushion out or absorb the transmission of such mechanical vibrations described above to the metering sleeve 50. Since the control shaft 68 is constantly urged to the left as viewed in FIG. 1 under the biasing force of the counter force spring 104 urging against the operation of the booster 70, there is expected such an effect to eliminate the dimensional play or loose fitting of the bearing 126 disposed at the rightmost end of the control shaft as viewed in FIG. 1, thus resulting in an assured transmission effect of the angled axial motion of the suction control shaft 78.

With the above described fuel injection pump of rotary type according to this invention, there are afforded such an improved fuel injection pump of rotary type wherein constant fuel injection operation is assured by virtue of the following advantageous features that upon change of the rotating number of the face cam shaft, there occurs control of fuel injection operation by causing the metering sleeve therein to be moved axially within the barrel of the pump by function of centrifugal forces rendered on the mechanical governor, thus maintaining the fuel injection volume per stroke of each plunger incorporated therewithin; upon change of the suction pressure of the engine there also occurs fuel injection control by causing the metering sleeve to be slided axially by function of the booster so as to change the fulcrum position or the basic operating point of the governor, thus relatively controlling the fuel injection volume irrespective of the changes of rotating number of the pump.

In addition, there is afforded another advantageous feature of this invention by adaptation of an Oldham's coupling arrangment to be incorporated between the governor shafting and the metering sleeve, such that static and/or dynamic unbalance existing in the mechanical construction of the governor assembly due to improper machining procedures thereof is well met as such coupling arrangmenet functions to cushion out or absorb mechanical vibrations created from the static or dynamic unbalance existing in the governor assembly; and further, there is provided such an outstanding secondary effect to prevent heat seizure or burning from occurring at the bearing area along the metering sleeve through the governor shafting by virtue of such cushioning-out effect of the coupling arrangment plus lubrication effected by the fuel to be applied therearound.

It should be understood, as indicated hereinbefore, that the preferred embodiment as described and shown hereinbefore does not mean in any way limitations of this invention, but on the contrary, many changes, variations and modifications with respect to the construction and arrangement in practice thereof may further be derived by those skilled in the art to which the present invention pertains, whereby the advantageous characteristics of this invention may be realized without departing from the spirit and scope of the invention as set forth hereinto in the appended claims.

What is claimed is:

1. In a combination of a plunger type fuel injection pump and an air throttled internal combustion engine having an air intake manifold, said combination including a housing having a central bore, fuel inlet and outlet passageways communicating with said central bore, a plurality of fuel passageways communicable with said central bore, and plurality of plunger receiving bores respectively communicated with said fuel passageways, said fuel passageways being connected to a source of fuel under pressure through said fuel inlet passageway; a plurality of plungers slidably disposed within said plunger receiving bores in an one-to-one relationship therewith, face cam means adapted to be rotated by said engine and to cause said plungers to be sequentially moved in reciprocating motion within said plunger receiving bores; a metering sleeve member slidably and rotatably disposed in said central bore and having a generally triangular projected cam portion on the cylindrical outer surface thereof, said projected cam portion being operable to close said fuel passageways in a selected sequence while said metering sleeve rotates; control shaft member coaxially disposed in said metering sleeve member and having one end engaging with said face cam means while permitting relative axial movement therebetween; a booster connected to the other end of said control shaft for shifting said control shaft toward said face cam means in accordance with the increase of the negative pressure in said air intake manifold of said engine; governor means mounted on said control shaft for moving said metering sleeve member toward said face cam means accordance to the increase of the rotational speed of said control shaft; and biasing means for biasing said metering sleeve and said control shaft toward said booster; THE IMPROVEMENT IN WHICH said biasing means comprises:

a retainer securely mounted on said control shaft in a position between said face cam means and said governor means;

a first spring member arranged between said face cam means and said retainer and biasing said control shaft toward said booster; and a second spring member arranged between said retainer and said metering sleeve member and biasing said metering sleeve member toward said booster with respect to said control shaft, said second spring member having a non-linear characteristic so that the axial movement of said metering sleeve member, due to the urging action of said governor means, relative to said control shaft is substantially in proportion to the rotational speed of said control shaft throughout the entire range of speeds of this shaft.

* * * * *